US008213644B2

(12) United States Patent
Choi

(10) Patent No.: US 8,213,644 B2
(45) Date of Patent: Jul. 3, 2012

(54) VIBRATION SPEAKER HAVING COMFORTABLE CONTACTING FACE PLATE AND PORTABLE TERMINAL

(76) Inventor: Seong Sik Choi, Icheon-Si (KR)

( * ) Notice: Subject to any disclaimer, the term of this patent is extended or adjusted under 35 U.S.C. 154(b) by 433 days.

(21) Appl. No.: 12/312,758

(22) PCT Filed: Nov. 27, 2007

(86) PCT No.: PCT/KR2007/006018
§ 371 (c)(1),
(2), (4) Date: May 26, 2009

(87) PCT Pub. No.: WO2008/066302
PCT Pub. Date: Jun. 5, 2008

(65) Prior Publication Data

US 2010/0054501 A1 Mar. 4, 2010

(30) Foreign Application Priority Data

Nov. 28, 2006 (KR) ..... 10-2006-0118312

(51) Int. Cl.
*H04R 1/00* (2006.01)

(52) U.S. Cl. ..... 381/151; 381/326; 381/380; 381/162; 600/25; 607/55; 607/57

(58) Field of Classification Search ..... 381/151, 381/380, 326, 162, 347, 391, 189, 426, 430, 381/403, 398; 600/25; 607/55, 57
See application file for complete search history.

(56) References Cited

U.S. PATENT DOCUMENTS

| | | | | |
|---|---|---|---|---|
| 2,311,416 | A * | 2/1943 | Salb et al. | 600/528 |
| 3,573,394 | A * | 4/1971 | Birnbaum | 600/528 |
| 4,516,428 | A * | 5/1985 | Konomi | 381/113 |
| 5,125,033 | A * | 6/1992 | Lee | 381/333 |
| 5,222,151 | A * | 6/1993 | Nagayoshi et al. | 381/380 |
| 5,321,763 | A * | 6/1994 | Lee | 381/301 |
| 5,337,364 | A * | 8/1994 | Fitch | 381/151 |
| 5,867,582 | A * | 2/1999 | Nagayoshi | 381/370 |
| 6,208,237 | B1 * | 3/2001 | Saiki et al. | 340/388.1 |
| 6,377,145 | B1 * | 4/2002 | Kumagai | 335/274 |
| 6,735,318 | B2 * | 5/2004 | Cho | 381/326 |
| 6,912,287 | B1 * | 6/2005 | Fukumoto et al. | 381/151 |
| 7,227,957 | B2 * | 6/2007 | Cheng | 381/71.6 |
| 7,319,773 | B2 * | 1/2008 | Lee et al. | 381/380 |
| 7,466,833 | B2 * | 12/2008 | Lee et al. | 381/151 |
| 7,724,913 | B2 * | 5/2010 | Ohara | 381/404 |
| 7,778,430 | B2 * | 8/2010 | Nakajima et al. | 381/151 |
| 7,961,553 | B2 * | 6/2011 | Kang | 367/183 |
| 2002/0027491 | A1 * | 3/2002 | Kim | 335/266 |

(Continued)

*Primary Examiner* — Ha Tran T Nguyen
*Assistant Examiner* — Jordan Klein
(74) *Attorney, Agent, or Firm* — GWiPS

(57) ABSTRACT

A vibration speaker with facial plate has developed for delivering sound in a form of vibrational movement to a user's skin. The vibration speaker includes a voice coil to generate a magnetic force in response to application of a sound signal from an exterior, a magnet having a predetermined magnetic force to interact with the magnetic force from the voice coil, a basket to receive the magnet, a face plate to deliver upward and downward movement of the voice coil or the magnet to the user's skin, and a rear cover coupled to the face plate to constitute an appearance of the vibration speaker. The face plate is provided with a plate-shaped tensioner providing a predetermined tension for maintaining the face plate in a horizontal state to control upward and downward vibrational movement delivered from the vibration speaker.

7 Claims, 8 Drawing Sheets

U.S. PATENT DOCUMENTS

2002/0094102 A1* 7/2002 Bito ..... 381/385
2003/0167077 A1* 9/2003 Blamey et al. ..... 607/57
2004/0247143 A1* 12/2004 Lantrua et al. ..... 381/151
2008/0063222 A1* 3/2008 Zheng et al. ..... 381/151
2009/0285417 A1* 11/2009 Shin et al. ..... 381/151

* cited by examiner

[Fig. 1] –Prior Art-
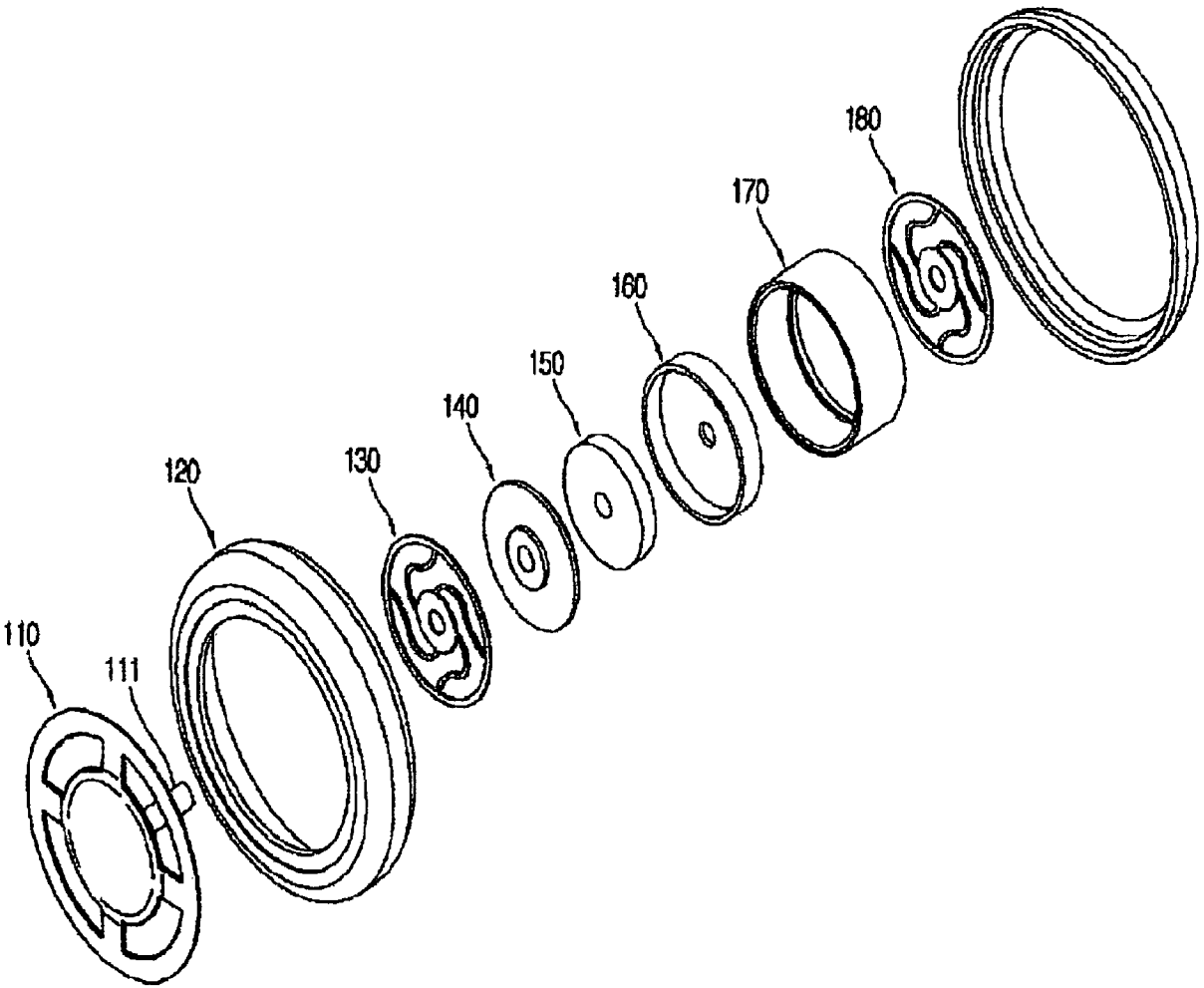

[Fig. 2] –Prior Art-
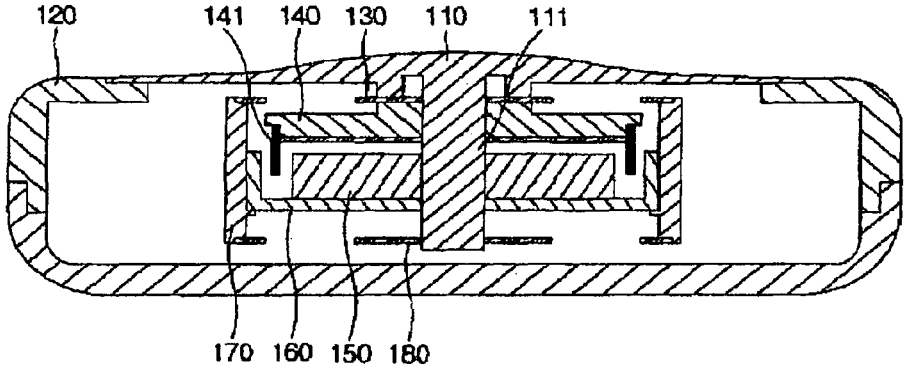
[Fig. 3]
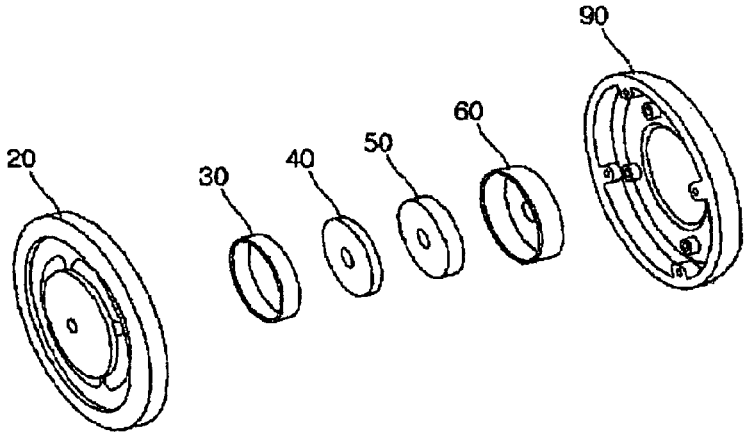
[Fig. 4]
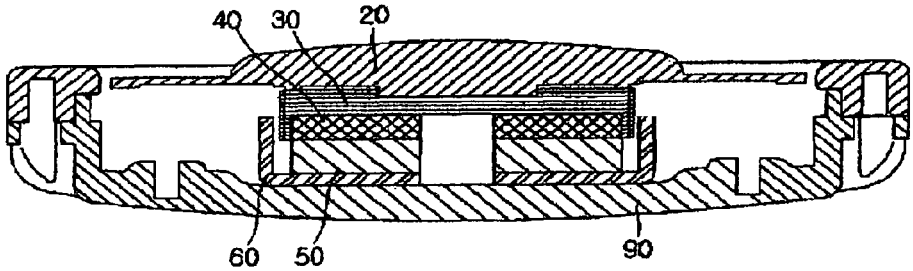

[Fig. 5]
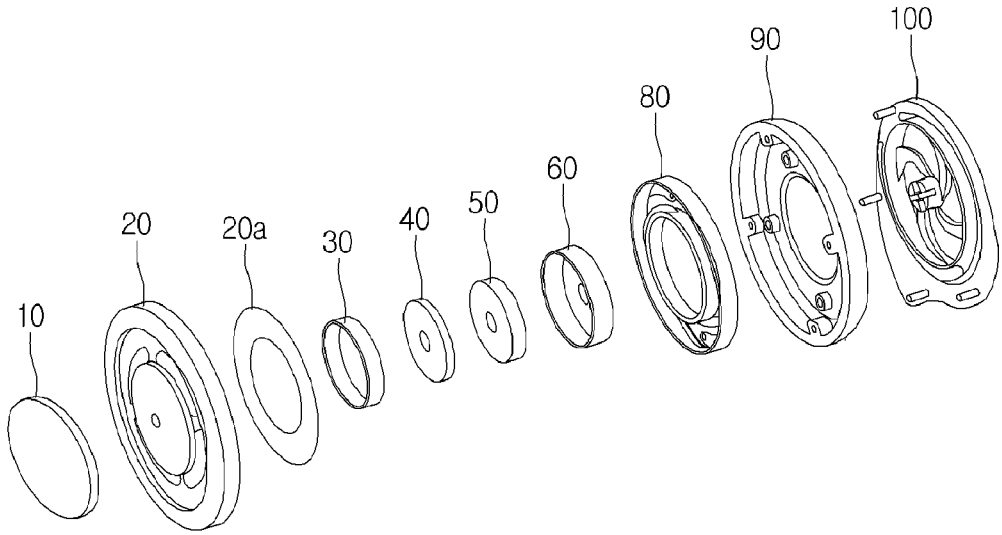
[Fig. 6]
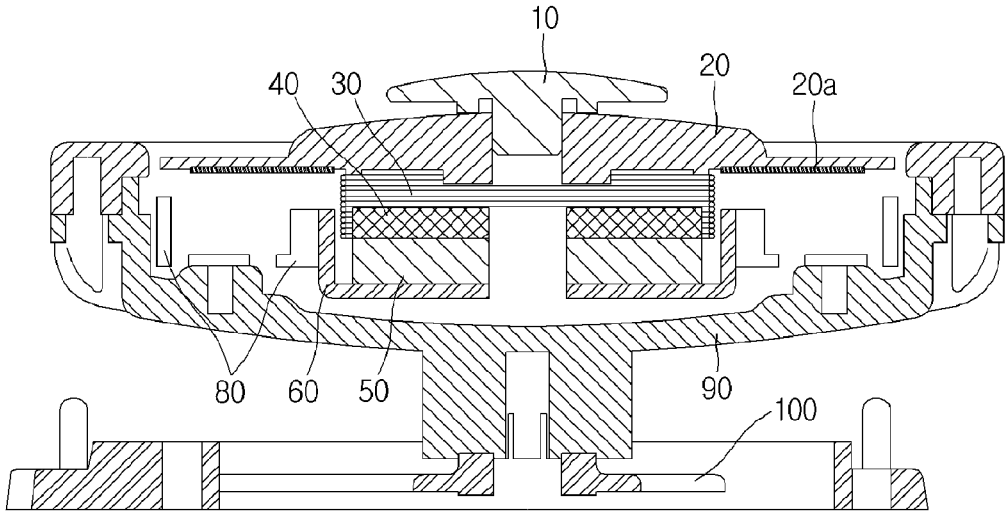

[Fig. 7]
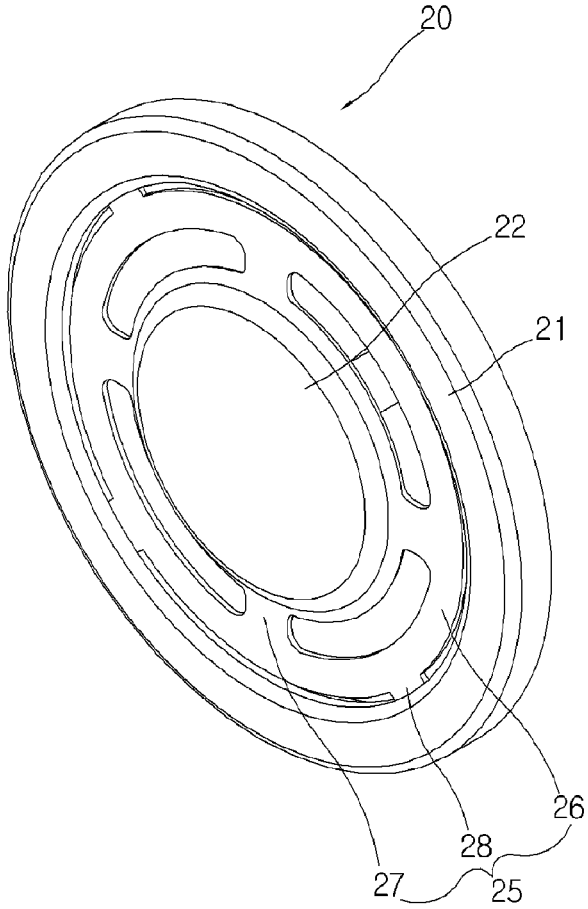
[Fig. 8]
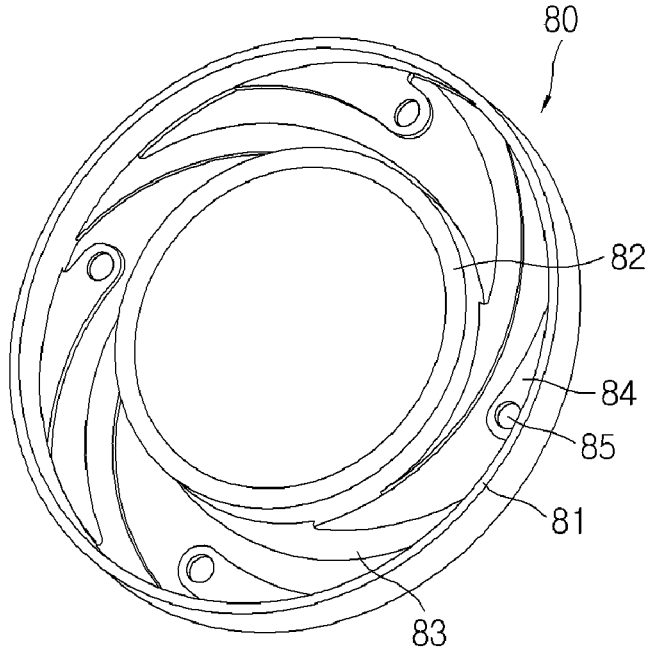

[Fig. 9]
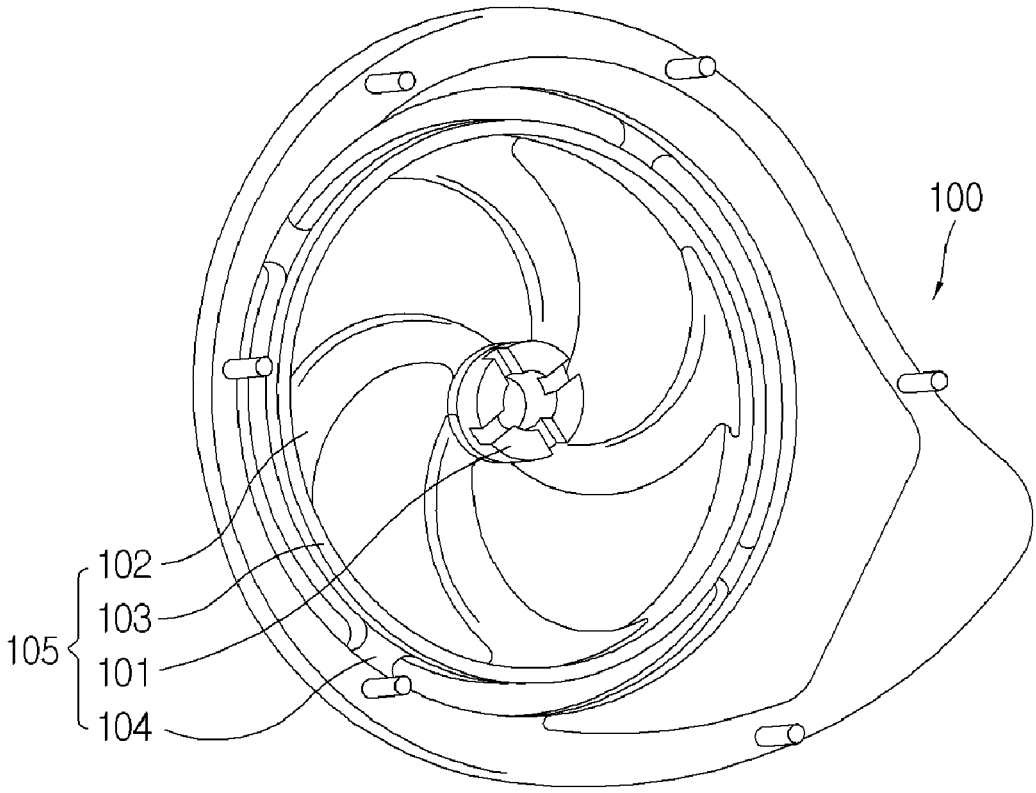

[Fig. 10]
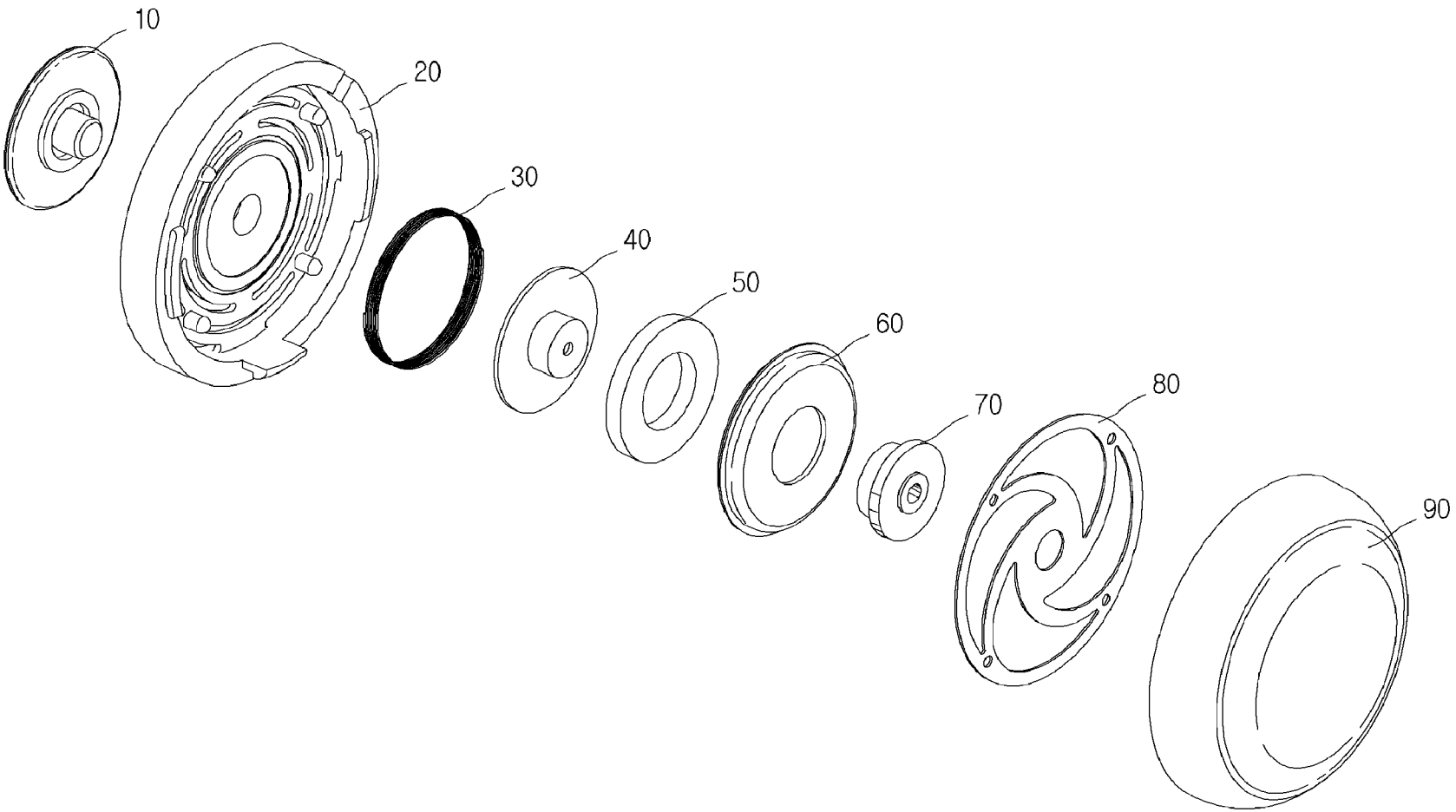

[Fig. 11]
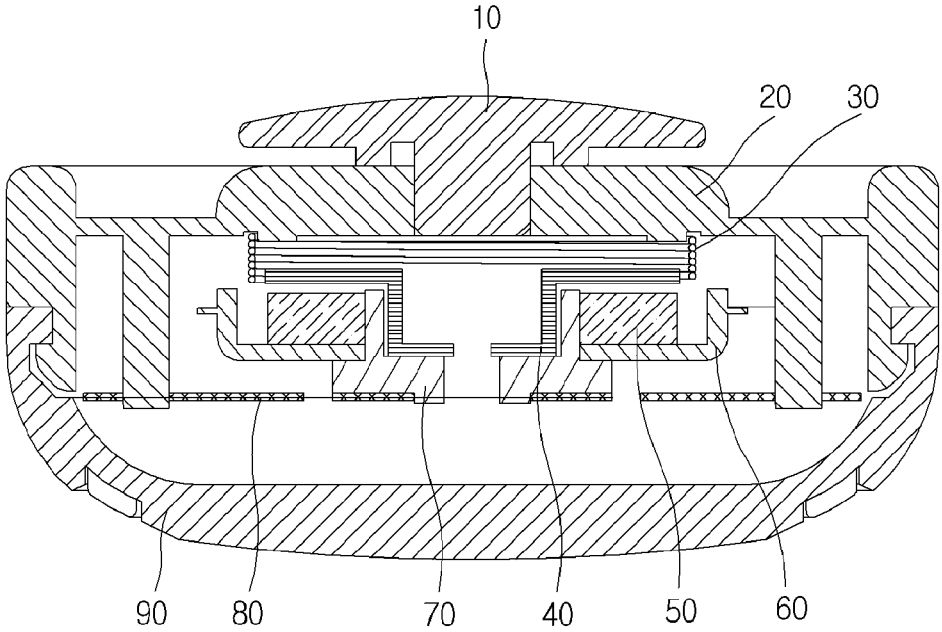
[Fig. 12]
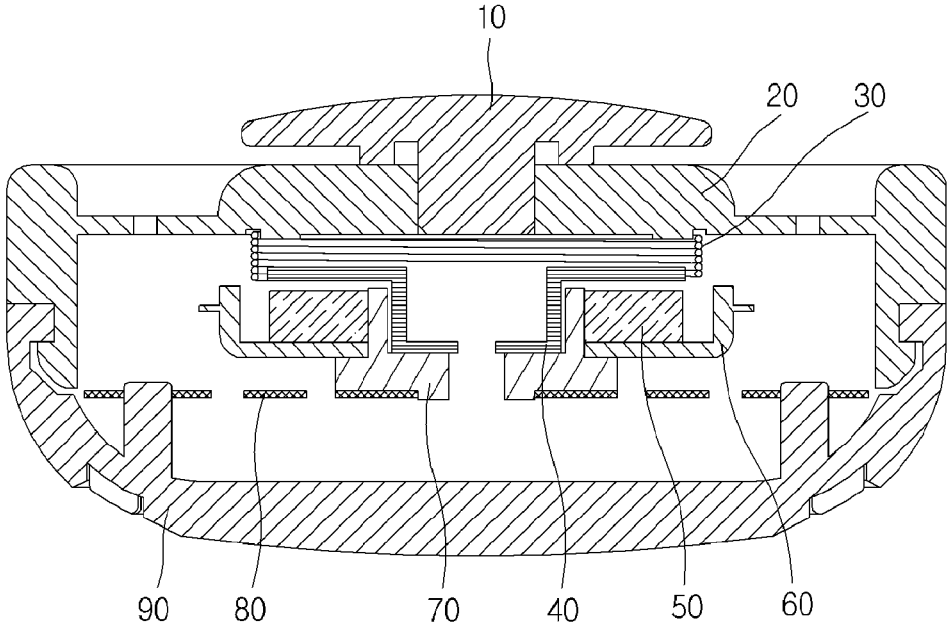

[Fig. 13]
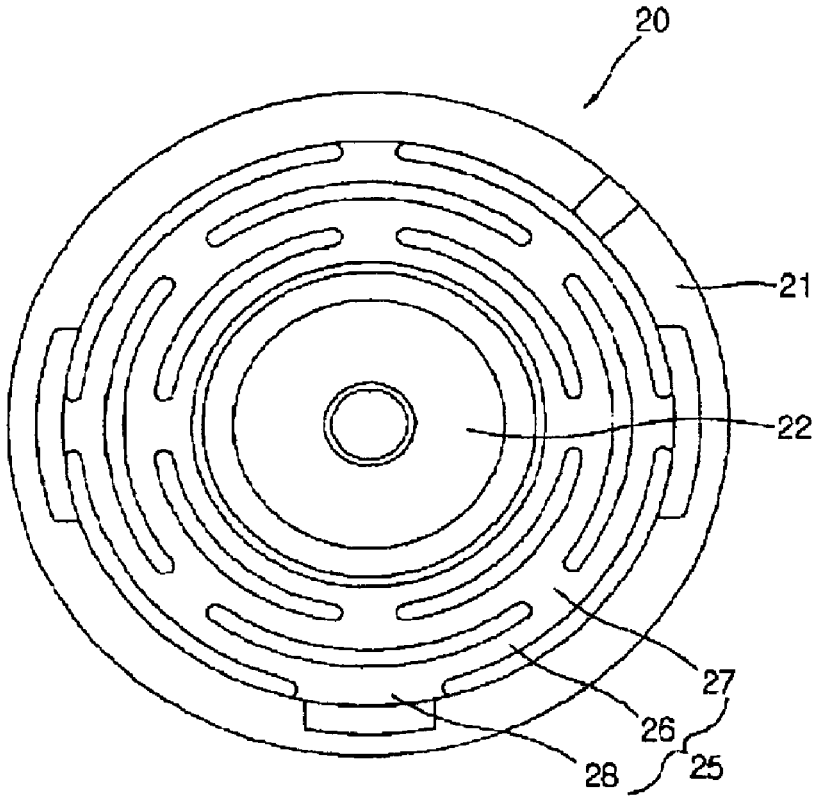
[Fig. 14]
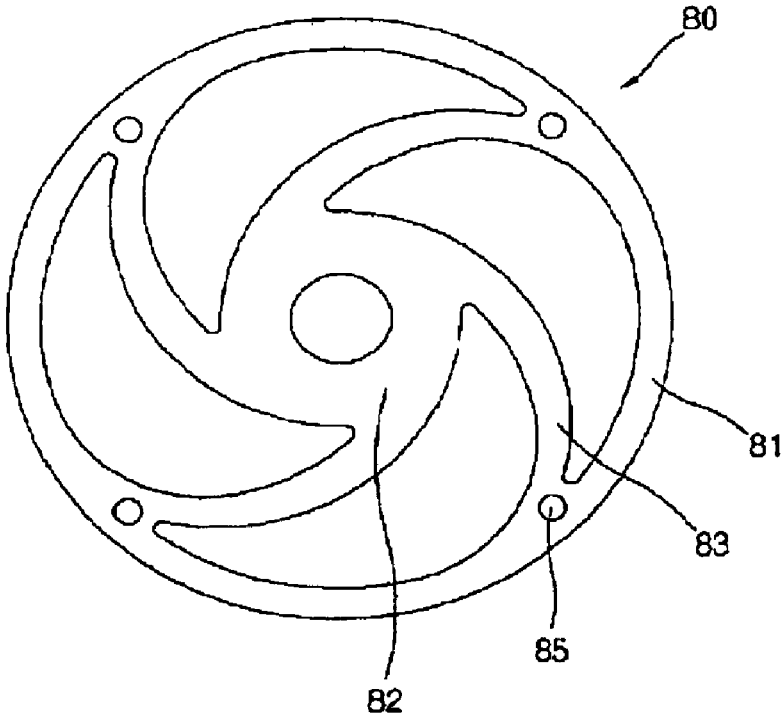

VIBRATION SPEAKER HAVING COMFORTABLE CONTACTING FACE PLATE AND PORTABLE TERMINAL

BACKGROUND OF THE INVENTION

1. Field of the Invention

The present invention relates to a face plate, a vibration speaker having facial plate, and a portable terminal including thereof. More particularly, the facial plate for a vibration speaker is contacted on a user's facial skin nearby ears, a vibration speaker that vibrates to impulse to the user's facial skin and has a tensioner integrated to the face plate contacting the user facial skin, so as to ensure a thinner dimension of the vibration speaker, and a portable terminal including the vibration speaker.

2. Related Prior Art

In general, sound perceived by a person is delivered in the form of waves to the ear, where the delivered sound waves move air molecules to vibrate the eardrum, allowing the person to hear the sound.

In more detail, as sound delivered in the form of waves into the ear through the external auditory meatus, i.e., through the auditory canal, vibrates the eardrum, cells in the auris interna inside the eardrum deliver vibration of the eardrum to the brain, so that the person can hear the sound.

Although audible sound is in the range of 20~20,000 Hz, sound suitable for the auditory sense of a person is in the range of 125~8,000 Hz as referred to as conversational range, and persons generally talk with one another in the frequency range of 500~2,000 Hz.

Further, although normal persons can perceive any sound in the range of 20~20,000 Hz, sound even in such an audible frequency range or of a specific frequency can be inaudible to persons suffering from deafness resulting from abnormality of the auris externa or the auris media, presbycusis, occupational deafness, etc.

One example of vibration speakers is disclosed in Korean Patent Application No 2006-92117 filed on Sep. 22, 2006 by the applicant of this invention.

Hereinafter, the vibration speaker of Korean Patent Application No 2006-92117 will be described with reference to FIGS. 1 and 2. The vibration speaker includes: a cylindrical case 120 opened at an upper side; a contact plate 110 residing on the open upper side of the case to be brought at an upper surface into contact with the skin of a user and having a penetration pin 111 extending from a lower surface of the contact plate into the case; an acoustic diaphragm 140 fixedly bonded to the contact plate to deliver sound generated inside the vibration speaker to the contact plate and having a central region through which the penetration pin passes; a voice coil 141 fixedly attached to a lower side of the acoustic diaphragm to generate a magnetic force in response to application of a sound signal from an exterior; a magnet 150 configured to physically vibrate through interaction with the magnetic force from the voice coil and having a central region through which the penetration pin passes; an open box-shaped magnet case 160 attached to a lower side of the magnet to vibrate along with vibrational movement of the magnet and having a central region through which the penetration pin passes; a cylindrical magnet holder 170 coupled to the magnet case 160 to vibrate along with the vibrational movement of the magnet; a first tension plate 130 coupled to an open upper side of the magnet holder to hold the magnet, the magnet case and the magnet holder during vibrational movements thereof while maintaining a distance between the voice coil and the magnet, and having a central region through which the penetration pin passes; and a second tension plate 180 coupled to an open lower side of the magnet holder and having a central region through which the penetration pin passes.

Since the contact plate and the first tension plate serving to deliver the vibrational movement to a wearer of the vibration speaker are separate components stacked on one another, the vibration speaker inevitably becomes thickened (in the vertical direction on the plane of the drawing).

SUMMARY OF THE INVENTION

Therefore, the present invention is conceived to solve the problems of the conventional techniques as described above, and an aspect of the present invention is to provide a face plate to deliver vibration to the skin of a user, a vibration speaker including a tensioner integrated to the face plate to have a thinner dimension, and a portable terminal including the vibration speaker.

In accordance with an aspect of the present invention, a vibration speaker for delivering sound in the form of vibrational movement from the vibration speaker to the skin of a user comprising: a voice coil (30) for generating a magnetic force in response to a sound signal from an exterior; a magnet (50) having a predetermined magnetic force for interacting with the magnetic force from the voice coil (30); a basket (60) for mounting the magnet (50); a rear cover (90) for coupling to the face plate (20) to form a shape of the vibration speaker; a face plate (20) consisting of an outer rim (21) formed an annular shape with a flat surface for contacting on the user's face, a central dome (22) formed a convex, and an integral tensioner (25) disposed between the outer rim (21) and the central dome (22), wherein said integral tensioner (25) consisting of a circular outer rim (26), a plurality of support branches (27) arranged with a constant interval around said central dome (22), and a plurality of linkages (28) for suspending said circular outer rim (26) and said central dome (22) to adjust the sound stress; and a tensioner (80) consisting of an inner annular ring (82) for inserting the basket (60), an outer ring (81), a plurality of spiral suspender (83) disposed between the inner ring (82) and the outer ring (81) and an insertion rib (84) with an insertion hole (85), wherein said tensioner (80) is coupled to said face plate (20) to constrain vibrational elements (coil 30, magnet 50 and basket 60) for pre-tensioning, so that said face plate (20) is maintained in a horizontal state to control upward and downward vibrational movement delivered from the vibration speaker. The face plate (20) further comprises a water-proof sheet (20*a*) disposed on an inner surface thereof to block penetrating moisture from outside of being introduced into the speaker. A mastoid (10) is disposed on a surface of the face plate (20) for contacting to the user's facial skin.

A horizontality stabilizer (100) consists of an integral tensioner (105) formed a thin plate shape with an inner ring (101) protruded to couple the rear cover (90), an outer ring (103), and a plurality of spiral suspender (102) disposed between the inner ring (101) and the outer ring (103), and a plurality of linkages (104) for retaining the outer ring (103), wherein the horizontality stabilizer (100) is for maintaining the speaker in the horizontal state.

In the vibration speaker according to the present invention, the face plate for delivering vibration to the skin of a user is integrally formed with the tensioner, enabling reduction in thickness of the vibration speaker, which leads to reduction in thickness of a portable terminal including the vibration speaker.

Additionally, in the vibration speaker according to the present invention, the tensioner integrally formed with the face plate generates a more forcible resilient force with respect to upward and downward vibrational movement generated from the speaker to accurately correspond to sound from the speaker, thereby improving sound accuracy.

Further, the speaker includes a water-proof sheet disposed therein to block sweat of the user or external moisture from being introduced into the speaker, enabling maintenance of durability of interior vibration components.

BRIEF DESCRIPTION OF THE DRAWINGS

FIG. 1 is an exploded perspective view of a conventional vibration speaker.

FIG. 2 is a cross-sectional view of the conventional vibration speaker.

FIG. 3 is an exploded perspective view of a vibration speaker in accordance with a first embodiment of the present invention.

FIG. 4 is a cross-sectional view of the vibration speaker in accordance with the first embodiment of the present invention.

FIG. 5 is an exploded perspective view of a vibration speaker in accordance with a second embodiment of the present invention.

FIG. 6 is a cross-sectional view of the vibration speaker in accordance with the second embodiment of the present invention.

FIG. 7 is a perspective view of one example of a face plate according to the present invention.

FIG. 8 is a perspective view of one example of a tensioner according to the present invention.

FIG. 9 is a perspective view of a horizontality assisting member according to the present invention.

FIG. 10 is an exploded perspective view of a vibration speaker in accordance with a third embodiment of the present invention.

FIG. 11 is a cross-sectional view of the vibration speaker in accordance with the third embodiment of the present invention.

FIG. 12 is a perspective view of another example of the face plate according to the present invention.

FIG. 13 is a perspective view of another example of the tensioner according to the present invention.

FIG. 14 is a perspective view of third example of the tensioner according to the present invention.

DETAILED DESCRIPTION OF THE PREFERRED EMBODIMENTS

Exemplary embodiments of the present invention will be described in detail with reference to the accompanying drawings.

First, a vibration speaker according to a first embodiment will be described. FIG. 3 is an exploded perspective view of a vibration speaker in accordance with a first embodiment of the present invention, and FIG. 4 is a cross-sectional view of the vibration speaker in accordance with the first embodiment.

Referring to FIGS. 3 and 4, the vibration speaker includes a face plate 20, a coil 30, a magnetic shielding plate 40, a magnet 50, a basket 60, and a rear cover 90.

The face plate 20 is directly brought into contact with the skin of a user and delivers vibration from the interior of the vibration speaker to the skin of the user. The face plate 20 is adapted to contact the skin and deliver the sound from the speaker to the skin, and is made of a smooth material such as silicon and the like such that sound can be smoothly delivered in the form of vibrational movement from the speaker to the skin through the face plate. In other words, the face plate 20 is a final sound delivering plate and has structure for adjusting sound stress of respective sound segments while enabling smooth delivery of the sound.

The coil 30 is bonded to a lower side of a diaphragm (not shown) by a heat resistant rubber-based strong adhesive and operates the speaker unit in response to application of a sound signal from an exterior through an extended line (not shown).

The magnet 50 and the basket 60 are located under the coil 30 with the magnet received within the basket 60.

The magnet 50 has a hollow shape and has predetermined magnetic properties. The magnet 50 is placed on the bottom of the basket 60 made of a metallic material, and is fixedly coupled to the basket 60 by a magnetic force and adhesives. Preferably, the magnet is a neodymium magnet.

The basket 60 is depressed in a box shape to permit generation of a magnetic field, and receives the magnet 60 such that a predetermined gap can be maintained between the magnet 50 and the periphery of the basket 60 to allow the coil 30 to be disposed between the magnet 50 and the periphery of the basket 60.

The magnet 50 is preferably bonded to the basket 60 by ultrasonic vibration bonding and adhesives.

Here, the basket 60 is configured to make air flow in one direction while enabling primary attenuation of sound, and serves as a body that determines connection between respective components.

The rear cover 90 defines an entire appearance of the vibration speaker, and provides a spatial case that presents a virtual sound stage along with the face plate inside the rear cover 90. The rear cover 90 has a configuration to reinforce a magnetic emission function of the magnet 50. Further, the rear cover 90 acts as a sound reflection plate and provides a covering function with respect to components of the speaker unit protruding outside.

Accordingly, when an electrical sound signal is applied from the outside to the coil 30, a magnetic force from the coil 30 interacts with the magnetic field from the magnet 50 to generate a physical vibration force of attraction and repulsion, which causes upward and downward vibrational movement of the coil 30 and magnet 50.

In other words, the vibration force resulting from application of the sound signal induces the vibrational movement of the coil 30 and magnet 50.

Next, the face plate 20 will be described in detail with reference to FIG. 7.

FIG. 7 shows one embodiment of the face plate 20 that has an integral tensioner 25. The face plate 20 is provided at an upper side with a plate-shaped outer rim 21, which will be brought into contact with the skin of a user, and at the center thereof with a circular central dome 22. The outer rim 21 and the central dome 22 have planar upper surfaces, which will contact the skin of the user.

A plate-shaped thin integral tensioner 25 is located between the outer rim 21 and the central dome 22. As shown in FIG. 7, the tensioner 25 includes an outer ring 26 corresponding to the circular outer rim 26, and a plurality of thin plate-shaped support branches 27 arranged inside the outer ring 26 to connect the central dome 22 to the outer ring 26.

Both of the outer ring 26 and the support branches of the tensioner 25 have a thin plate shape.

Therefore, the outer rim 21 and the central dome 22 of the face plate 20 are brought into contact with the skin of the user and deliver internal vibration to the skin in such a way of giving an impulse to the skin of the user. Further, the integral tensioner 25 provides a predetermined tension for maintaining the face plate in a horizontal state to control vibration delivered from the interior of the speaker when sound is delivered from the speaker. Thus, only by adjusting the tension of the integral tensioner 25, it is possible to allow the face plate to deliver vibration suitable for giving an impulse to the skin of the user even when excessive vibration is generated inside the speaker.

Here, in order to ensure a stronger tension, the outer rim 21 is joined to the outer ring 26 via a plurality of linkages 28, which are preferably arranged in an alternate manner on a concentric circle with respect to the plate-shaped support branches 27, which connect the outer ring to the central dome 22.

Namely, referring to FIG. 7, when connecting the outer rim 21 to the outer ring 26, each of the linkages 28 is located at each middle location between four support branches 27 so that the integral tensioner 25 is given stronger and smoother elasticity, which makes it possible for the face plate to more accurately cope with the vibrational movement generated inside the speaker and sound created thereby.

Next, a vibration speaker according to a second embodiment of the present invention will be described.

FIG. 5 is an exploded perspective view of the vibration speaker according to the second embodiment of the present invention, and FIG. 6 is a cross-sectional view of the vibration speaker of the second embodiment.

Referring to FIGS. 5 and 6, the vibration speaker includes a mastoid 10, a face plate 20, a water-proof sheet 20*a*, a coil 30, a magnetic shielding plate 40, a magnet 50, a basket 60, a tensioner 80, a rear cover 90, and a horizontality assisting member 100.

Description of the same components as those of the first embodiment will be omitted herein.

The mastoid 10 is fitted and coupled into a hole of the face plate 20, and will be brought into contact with the skin of a user to smoothly deliver vibration of the speaker to the user.

The water-proof sheet 20*a* blocks sweat of the user or external moisture from being introduced into the speaker through orifices of the face plate 20, enabling maintenance of durability of interior vibration components. The water-proof sheet 20*a* can be made of Temi-sheet.

The magnetic shielding plate 40 serves to guide a magnetic field.

The tensioner 80 serves to hold the basket 60 where the magnet 50 is received, such that the magnet 50 can be moved in a space inside the basket 60.

Referring to FIG. 8, the tensioner 80 includes an inner ring 82, into which the basket 60 is inserted, an outer ring 81, and round support branches 83 disposed around the inner ring 82 to connect the inner ring 82 to the outer ring 81.

With such a configuration, the tensioner 80 provides tension for maintaining the basket in a horizontal state, and forcibly supports the basket 60, which receives the magnet 50 therein, such that the basket 60 can be maintained in the horizontal state while the basket 60 moves.

Further, since the tensioner 80 maintains the magnet 50 in the horizontal state by directly holding the magnet 50, which fluctuates up and down, and makes rapid reversion of the magnet 50, a light magnet can substitute for a heavy magnet only by adjusting the tension of the tensioner 80.

Hence, the tensioner 80 can be adjusted to have a stronger tension, which provides the same effects as in the case of using a heavy magnet to obtain bass sound enhancement or sound stage presentation and to accurately express original sound.

Furthermore, since the tensioner 80 has the configuration to allow the basket 60 to be fitted into the tensioner 80, the speaker can decrease in diameter as a whole, which makes it possible to manufacture a smaller speaker.

The tensioner 80 further includes an insertion rib 84 having an insertion hole 85, and is secured to the rear cover 90 by a bolt and the like through the insertion hole 85 and maintains the tension in a state of being separated from the bottom of the rear cover 90, thereby allowing the basket 60, which receives the magnet 50 therein, to be maintained in the horizontal state (see FIG. 6).

In this configuration of the second embodiment, both the coil 30 and the magnet 50 vibrate together. Accordingly, it is possible to deliver accurate sound by adjusting the tension of the tensioner 80.

On the other hand, when the speaker unit is brought into close contact with the skin of the user, the mastoid 10 or the face plate 20 is somewhat pushed into the speaker by the skin of the user.

In order to prevent this phenomenon, the tensioner 80 may be secured to the face plate 20 instead of the rear cover 90 by the bolt and the like (FIGS. 11*a* and 11*b* show two methods for securing the tensioner to the face plate 20).

When the tensioner 80 is secured to the face plate 20, since the tensioner 80 is pushed along with the face plate 20 into the speaker unit even in the case where the face plate 20 is pushed by the skin of the user, sound can be accurately delivered in the form of vibrational movement to the skin of the user without variation in location of the magnet 50 between contact and non-contact with respect to the skin.

Further, the horizontality assisting member 100 connects the speaker to a band of a headset to hold the speaker in the horizontal state as a whole when the speaker is brought into contact with the skin of the user.

That is, in order to prevent the speaker from non-uniformly contacting the skin of the user depending on a face angle of the user when the speaker is brought into contact with the skin of the user, the horizontality assisting member 100 is attached to the rear side of the rear cover 90 and maintains the horizontality of the speaker over an entire angle of 360 degrees to allow the speaker unit to uniformly contact the skin of the user irrespective of the face angle. Referring to FIG. 9, the horizontality assisting member 100 includes an integral tensioner 105 disposed therein to maintain the speaker in the horizontal state. The integral tensioner 105 has a thin plate shape, and includes an inner ring 101 into which a protrusion for coupling to the rear cover 90 is fitted, an outer ring 103, and round support branches 102 disposed around the inner ring 101 to connect the inner ring 101 to the outer ring 103. The integral tensioner 105 is disposed inside the horizontality assisting member 100 via a plurality of linkages 104. The horizontality assisting member 100 is coupled to the outer ring 105 of the integral tensioner 105 by the plurality of linkages 104. Preferably, in order to ensure a stronger tension for maintaining the horizontality of the speaker, the linkages 104 are arranged in an alternate manner on a concentric circle with respect to connection points between the outer ring 103 and the support branches 102, which connect the outer ring 103 to the inner ring 101.

The voice coil (30) is for generating a magnetic force in response to a sound signal from an exterior. The magnet (50) has provided a predetermined magnetic force for interacting with the magnetic force from the voice coil (30). The basket (60) is for mounting the magnet (50). The rear cover (90) is for coupling to the face plate (20) to form a shape of the vibration speaker; The face plate (20) consists of an outer rim (21) formed an annular shape with a flat surface for contacting on the user's face, a central dome (22) formed a convex, and an integral tensioner (25) disposed between the outer rim (21)

and the central dome (22). The integral tensioner (25) consists of a circular outer rim (26), a plurality of support branches (27) arranged with a constant interval around the central dome (22), and a plurality of linkages (28) for suspending the circular outer rim (26) and the central dome (22) to adjust the sound stress. The tensioner (80) consists of an inner annular ring (82) for inserting the basket (60), an outer ring (81), a plurality of spiral suspender (83) disposed between the inner ring (82) and the outer ring (81) and an insertion rib (84) with an insertion hole (85). The tensioner (80) is coupled to the face plate (20) to constrain vibrational elements (coil 30, magnet 50 and basket 60) for pre-tensioning, so that the face plate (20) is maintained in a horizontal state to control upward and downward vibrational movement delivered from the vibration speaker. The face plate (20) further comprises a water-proof sheet (20*a*) disposed on an inner surface thereof to block penetrating moisture from outside of being introduced into the speaker. The mastoid (10) is disposed on a surface of the face plate (20) for contacting to the user's facial skin.

The horizontality stabilizer (100) consists of an integral tensioner (105) formed a thin plate shape with an inner ring (101) protruded to couple the rear cover (90), an outer ring (103), and a plurality of spiral suspender (102) disposed between the inner ring (101) and the outer ring (103), and a plurality of linkages (104) for retaining the outer ring (103), wherein the horizontality stabilizer (100) is for maintaining the speaker in the horizontal state.

Next, a vibration speaker according to a third embodiment of the present invention will be described.

FIG. 10 is an exploded perspective view of the vibration speaker according to the third embodiment of the present invention, and FIG. 11 is a cross-sectional view of the vibration speaker of the third embodiment.

Referring to FIGS. 10 and 11, the vibration speaker of this embodiment includes a mastoid 10, a face plate 20, a coil 30, a magnetic shielding plate 40, a magnet 50, a basket 60, a bushing 70, a tensioner 80, and a rear cover 90.

Description of the same components as those of the first and second embodiments will be omitted herein.

Referring to FIG. 12, another embodiment of the integral tensioner 25 included in the face plate 20 is shown.

In FIG. 12, the face plate 20 includes a plate-shaped outer rim 21, of which upper side will be brought into contact with the skin of a user, and a circular central dome 22 disposed at a center of the face plate 20.

The thin plate-shaped integral tensioner 25 is disposed between the outer rim 21 and the central dome 22. As shown in FIG. 12, the integral tensioner 25 includes a plurality of circular outer rings 26 corresponding to the circular outer rim 21 and connected to one another by a plurality of support branches 27. With this configuration, the plural outer rings 26 provide a stronger tension for maintaining the horizontality to the face plate 20.

The support branches 27 connecting the outer rings 26 to one another are also alternately arranged on a concentric circle. Further, it is desirable that the support branches 27 connected to an outermost ring 26 are alternately arranged on the concentric circle with respect to the linkages 28, which connect the outermost ring 26 to the outer rim 21.

On the other hand, the magnet 50 and the basket 60 have a through-hole formed therein such that a protrusion of the magnetic shielding plate 40 is lowered to be fitted into the through-holes and the hollow bushing 70 is raised to be inserted into the through-hole.

Specifically, referring to FIGS. 11*a* and 11*b*, the hollow bushing 70 is fitted into the through-hole to be located around the protrusion of the magnetic shielding plate 40, and then, the through-holes of the magnet 50 and basket 60 are fitted onto an outer surface of the hollow bushing 70, thereby integrating the magnetic shielding plate 40, the magnet 50, the basket 60, and the bushing 70.

Then, the lower side of the bushing 70 is supported by the tensioner 80.

In this regard, referring to FIG. 13, a fastener such as a bolt and the like is inserted into the inner ring 82 of the tensioner 80, and is then inserted into a through-hole on the rear side of the bushing 70 to integrate the tensioner 80 and the bushing 70. As a result, the magnetic shielding plate 40, the magnet 50, the basket 60, and the bushing 70 become integrated, as described above, and are then integrated onto the tensioner 80.

Additionally, the tensioner 80 is secured to the rear cover 90 (see FIG. 11*b*) or to the face plate 20 (see FIG. 11*a*) by inserting fasteners such as bolts and the like into insertion holes 85 respectively located at connection points between the support branches 87 and the outer rings 81 of the tensioner 80.

As a result, the tensioner 80 maintains the magnet 50 in the horizontal state by providing tension while being separated from the bottom of the rear cover.

In accordance with another embodiment of the present invention, the vibrational speaker is further comprising; a bushing (70) for inserting behind the basket (60); a tensioner (80) consisting of an inner ring (82) formed a cyclone shape for inserting the bushing (70) at its center, an outer ring (81), a plurality of spiral suspender (83) disposed between the inner ring (82) and the outer ring (81) and an insertion hole (85).

The vibration speaker having the configuration as described above is disposed inside a receiver of a portable terminal and will be brought into contact with the skin of a user to directly deliver sound message from the speaker to the user in the form of vibrational movement. In this case, since the vibration speaker of the present invention has a smaller size than a typical acoustic speaker, the portable terminal can be decreased in dimensions.

Although the selected embodiments have been described along with the accompanying drawings, the present invention is not limited to these embodiments and drawings, and it will be apparent to those skilled in the art that various modifications, additions and substitutions can be made without departing from the scope and spirit of the invention as disclosed in the accompanying claims.

What is claimed is:

1. A vibration speaker delivers sound in a form of vibrational movement to a user's facial skin nearby ears, the vibration speaker comprising:

a voice coil (30) for generating a magnetic force in response to a sound signal from an exterior;

a magnet (50) having a predetermined magnetic force for interacting with the magnetic force from the voice coil (30);

a basket (60) for mounting the magnet (50);

a rear cover (90) for coupling to a face plate (20) to form a shape of the vibration speaker;

the face plate (20) consisting of an outer rim (21) having an annular shape with a flat surface for contacting on the user's face, a central dome (22) having a convex shape, and an integral tensioner (25) disposed between the outer rim (21) and the central dome (22), wherein said integral tensioner (25) consisting of a circular outer rim (26), a plurality of support branches (27) arranged with a constant interval around said central dome (22), and a plurality of linkages (28) for suspending said circular outer rim (26) and said central dome (22) to adjust the sound stress; and a tensioner (80) consisting of an inner annular ring (82) for inserting the basket (60), an outer ring (81), a plurality of spiral suspenders (83) disposed between the inner ring (82) and the outer ring (81) and an insertion rib (84) with an insertion hole (85), wherein said tensioner (80) is coupled to said face plate (20) to constrain vibrational elements (voice coil (30), magnet (50) and basket (60)) for pre-tensioning, so that said face plate (20) is maintained in a horizontal state to control upward and downward vibrational movement delivered from the vibration speaker.

2. The vibration speaker according to claim 1, wherein the face plate (20) further comprises a water-proof sheet (20*a*) disposed on an inner surface thereof to block penetrating moisture from outside of the speaker.

3. The vibration speaker according to claim 1, further comprising: a mastoid (10) disposed on a surface of the face plate (20) for contacting to the user's facial skin.

4. The vibration speaker according to claim 1, further comprising a portable terminal as a receiver.

5. The vibration speaker according to claim 1, further comprising;

a horizontality stabilizer (100) consists of an integral tensioner (105) formed a thin plate shape with an inner ring (101) protruded to couple the rear cover (90), an outer ring (103), and a plurality of spiral suspender (102) disposed between the inner ring (101) and the outer ring (103), and a plurality of linkages (104) for retaining the outer ring (103), wherein the horizontality stabilizer (100) is for maintaining the speaker in the horizontal state.

6. A vibration speaker delivers sound in a form of vibrational movement from the vibration speaker to a user's facial skin nearby ears, the vibrational speaker comprising:

a face plate (20) consisting of an outer rim (21) having an annular shape with a flat surface for contacting on the user's face, a central dome (22) having a convex shape, and an integral tensioner (25) disposed between the outer rim (21) and the central dome (22), wherein said integral tensioner (25) of the face plate (20) is further comprising a plurality of concentric circular outer rims (26), a plurality of support branches (27) arranged with constant intervals along with the concentric circular outer rims (26), and a plurality of linkages (28) for suspending said concentric circular outer rim (26) and said central dome (22) to adjust the sound stress;

a water-proof sheet (20*a*) for preventing moisture penetration;

a voice coil (30) for generating a magnetic force in response to a sound signal from an exterior;

a magnet (50) having a predetermined magnetic force to interact with the magnetic force from the voice coil;

a basket (60) for mounting the magnet (50);

a bushing (70) for inserting behind the basket (60);

a rear cover (90) for coupling to the face plate (20) to form a shape of the vibration speaker; and a tensioner (80) consisting of an inner annular ring (82) for inserting the basket (60), an outer ring (81), a plurality of spiral suspenders (83) disposed between the inner ring (82) and the outer ring (81) and an insertion rib (84) with an insertion hole (85), wherein said tensioner (80) is coupled to said face plate (20) to constrain vibrational elements (voice coil (30), magnet (50) and basket (60)) for pre-tensioning, so that said face plate (20) is maintained in a horizontal state to control upward and downward vibrational movement delivered from the vibration speaker.

7. The vibration speaker according to claim 6, further comprising a portable terminal as a receiver.

* * * * *